US007398713B2

(12) United States Patent
Davidson

(10) Patent No.: US 7,398,713 B2
(45) Date of Patent: Jul. 15, 2008

(54) QUICK RELEASE MECHANISM FOR TOOLS SUCH AS SOCKET WRENCHES

(75) Inventor: John B. Davidson, Chicago, IL (US)

(73) Assignee: JODA Enterprises, Inc., Chicago, IL (US)

( * ) Notice: Subject to any disclaimer, the term of this patent is extended or adjusted under 35 U.S.C. 154(b) by 49 days.

(21) Appl. No.: 10/520,776

(22) PCT Filed: Oct. 10, 2002

(86) PCT No.: PCT/US02/32633

§ 371 (c)(1),
(2), (4) Date: Jan. 7, 2005

(87) PCT Pub. No.: WO03/047817

PCT Pub. Date: Jun. 12, 2003

(65) Prior Publication Data

US 2006/0117918 A1 Jun. 8, 2006

Related U.S. Application Data

(60) Provisional application No. 60/336,612, filed on Dec. 4, 2001.

(51) Int. Cl.
*B25B 23/16* (2006.01)
*B25G 1/00* (2006.01)

(52) U.S. Cl. ..... 81/177.85; 81/177.2; 81/177.8; 81/177.85

(58) Field of Classification Search ..... 81/177.2, 81/177.8, 177.85
See application file for complete search history.

(56) References Cited

U.S. PATENT DOCUMENTS

| | | | | |
|---|---|---|---|---|
| 3,011,794 | A * | 12/1961 | Vaughn | 279/76 |
| 4,571,113 | A * | 2/1986 | Coren | 403/322.1 |
| 4,768,405 | A | 9/1988 | Nickipuck | |
| 4,848,196 | A | 7/1989 | Roberts | |
| 4,938,107 | A | 7/1990 | Nickipuck | |
| 5,644,958 | A * | 7/1997 | Roberts et al. | 81/177.85 |
| 5,813,296 | A | 9/1998 | Hoff et al. | |
| 5,911,800 | A | 6/1999 | Roberts et al. | |
| 6,182,536 | B1 | 2/2001 | Roberts et al. | |

OTHER PUBLICATIONS

International Search Report for International Application No. PCT/US02/32633 dated Jan. 15, 2003.

* cited by examiner

*Primary Examiner*—Joseph J. Hail, III
*Assistant Examiner*—Shantese McDonald
(74) *Attorney, Agent, or Firm*—Brinks Hofer Gilson & Lione

(57) ABSTRACT

A tool of the type having a drive stud for receiving and releasing a tool attachment includes an opening in the drive stud and a locking pin movably mounted in the opening. The opening defines first and second ends, and the first end of the opening is located at a portion of the drive stud constructed for insertion into the tool attachment. An actuating member is movably positioned on the drive stud, and the actuating member defines a sliding surface that engages the pin. A first spring biases the sliding surface toward the pin, and a second, weaker spring biases the pin toward the sliding surface. The first spring reacts against a ring that is disposed between the spring and a shoulder formed on the tool. The shoulder extends away from the longitudinal axis of the drive stud by a lesser distance than the spring or the ring.

42 Claims, 1 Drawing Sheet

QUICK RELEASE MECHANISM FOR TOOLS SUCH AS SOCKET WRENCHES

RELATED APPLICATIONS

This application is the National Stage of International Application No. PCT/US02/32633, filed Oct. 10, 2002, which claims the benefit of U.S. Provisional Application No. 60/336,612, filed Dec. 4, 2001.

BACKGROUND

This invention relates to torque transmitting tools of the type having a drive stud shaped to receive and release a tool attachment, and in particular to an improved quick release mechanism for securing and releasing a tool attachment to and releasing it from the drive stud.

U.S. Pat. No. 5,644,958 describes an effective quick release mechanism for securing tool attachments such as sockets to torque transmitting tools such as wrenches and extension bars. In the disclosed mechanism, the tool includes a drive stud which defines a diagonally oriented opening, and a locking pin is positioned within the opening to move in the opening. In its engaging position, a first end of the locking pin engages a recess in the socket to lock the socket positively in place on the drive stud. When the operator moves the pin in the opening, the first end of the pin is moved out of contact with the socket, and the socket is released from the drive stud.

In the disclosed mechanism of U.S. Pat. No. 5,644,958, the locking pin is biased downwardly by a spring that bears against a large shoulder 52 on the extension bar. This approach requires that the extension bar under the spring be machined or otherwise formed to a substantially smaller diameter than the relatively large-diameter portion of the extension bar immediately above the shoulder 52.

SUMMARY

By way of introduction, the quick release mechanism shown in the drawing includes a diagonal pin mounted in an opening and biased to the left (in the drawing) by a coil spring disposed around the tool. The one end of the coil spring bears on a ring that in turn bears on a shoulder formed by the tool facing the spring. The illustrated shoulder is relatively low profile, and the surface of the tool on the radially outer side of the shoulder does not extend as far radially away from the longitudinal axis of the tool as does the spring or the ring.

By eliminating the need for a deep shoulder of the type shown in U.S. Pat. No. 5,644,958, the diameter of the tool in the region of the spring is made-more nearly equal to the diameter of the tool in the region above the spring. This feature makes possible a sleek design that is well-suited for use in tight and hard to reach spaces.

BRIEF DESCRIPTION OF THE DRAWING

FIG. 2 is a cross-sectional view of an extension bar that incorporates a second presently preferred embodiment of the present invention.

DETAILED DESCRIPTION

Figure 1:
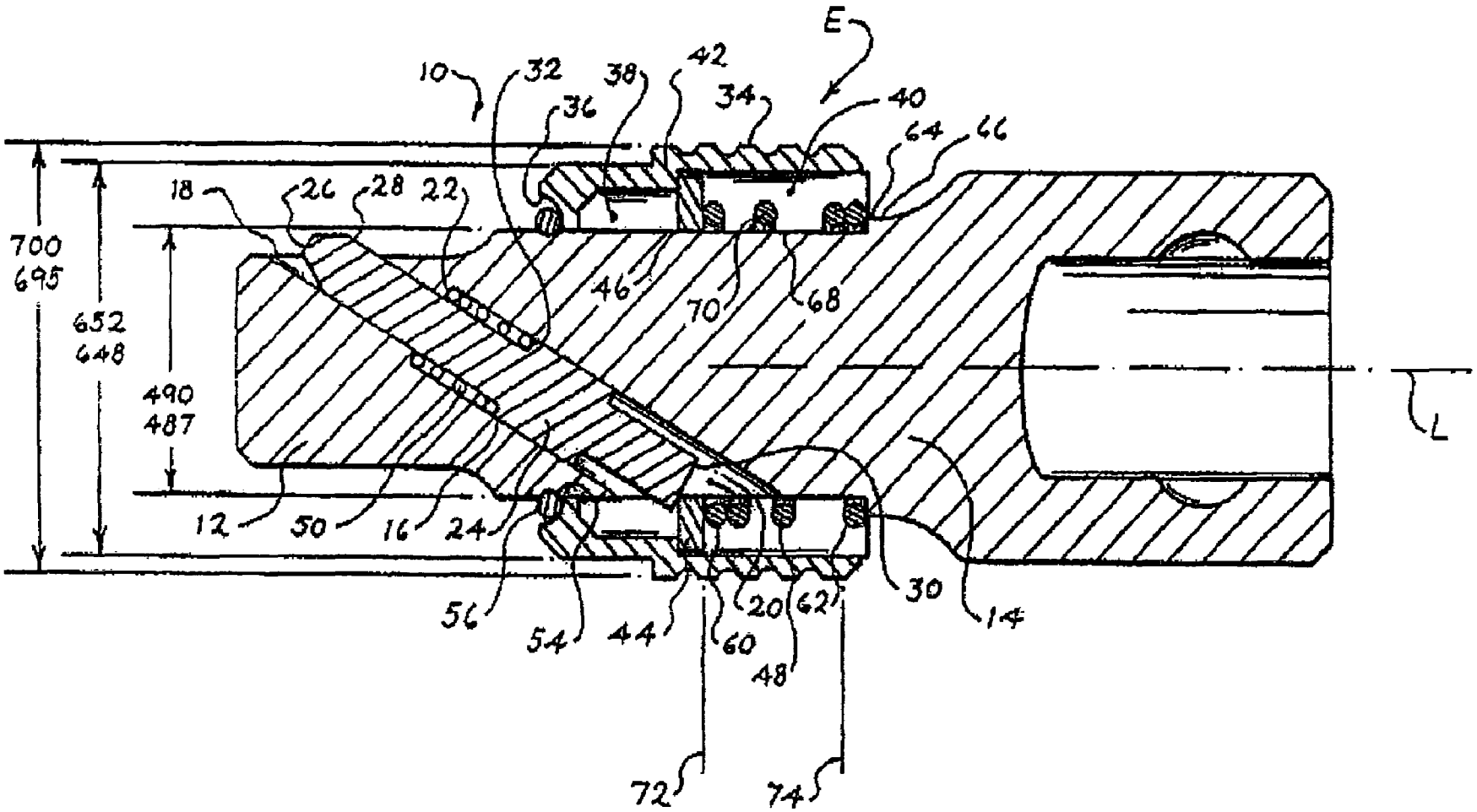
FIG. 1 is a cross-sectional view of an extension bar that incorporates a presently preferred embodiment of the present invention.

Turning now to the drawing, FIG. 1 shows a side elevational view of a tool which in this preferred embodiment includes an extension bar E. The extension bar E is designed to be mounted on a wrench (not shown) and to fit into and transmit torque to a socket (not shown) The extension bar terminates at one end in a drive stud 10 having a first portion 12 and a second portion 14. The first portion 12 is constructed for insertion into a socket, and defines an out-of-round cross section. Typically, the first portion 12 has a square, hexagonal or other non-circular shape in horizontal cross section. The second portion 14 will often define a circular cross section, though this is not required.

As shown in FIG. 1, the drive stud 10 defines a diagonally positioned passageway 16 having a first end 18 and a second end 20. The first end 18 is positioned in the first portion 12 of the drive stud 10, and the second end 20 is positioned in the second portion 14 of the drive stud 10. The opening 16 has a larger diameter adjacent the second end 20 than the first end 18, and the opening 16 defines a transverse step 22 between the larger and smaller diameter portions of the opening 16.

It may be preferable in some embodiments to provide the opening 16 with a constant diameter, and to define the step 22 in some other manner, as for example with a plug of the type shown in FIG. 20 of U.S. Pat. No. 4,848,196.

As shown in FIG. 1, a locking element such as a pin 24 is slidably positioned in the opening 16. This pin 24 defines a first end 26 shaped to engage the socket and a second end 30. The first end 26 of the pin 24 may be formed in any suitable shape. For example, it can be conventionally rounded, or it may alternately be provided with a step as shown in U.S. Pat. No. 4,848,196. Though illustrated as a pin 24, the locking element may take various shapes, including irregular and elongated shapes. The purpose of the locking element is to hold the tool attachment in place on the drive stud during normal use, for example when pulled by a user, and the term "locking" does not imply locking the tool attachment in place against all conceivable forces tending to dislodge the tool attachment. If desired, the pin 24 may be provided with an out-of-round cross section and the opening 16 may define a complementary shape such that a preferred rotational position of the pin 24 in the opening 16 is automatically obtained.

The pin 24 defines a reduced diameter portion 28 adjacent the first end 26. A shoulder 32 is formed at an intermediate portion of the pin 24 adjacent one edge of the reduced diameter portion 28.

Also as shown in FIG. 1, an actuator such as a collar 34 is positioned around the second portion 14 of the drive stud 10. The collar 34 is annular in shape, and the interior surface of the collar 34 defines first, second and third recesses 36, 38, 40. The transition between the second and third recesses 38, 40 forms a ledge 42. A ring 44 is positioned within the collar 34 in the third recess 40, between the collar 34 and the drive stud 10. This ring 44 may be free to rotate and to translate along the length of the collar 34, and the ring 44 defines a sliding surface 46. The sliding surface 46 faces the pin 24.

Though the actuating member is shown as a collar 34 that slides along the longitudinal axis L, an alternate embodiment of the actuating member may be formed as a slide that does not encircle the drive stud 10. The ring may be considered as a part of the actuator, and the sliding surface 46 may be formed as an integral part of the collar 34 if desired.

As shown in FIG. 1, the drive stud 10 defines a longitudinal axis L, and the collar 34 is guided to move along the longitudinal axis L.

A releasing spring 50 biases the pin 24 to the release position, toward the ring 44. As shown, the releasing spring 50 is a compression coil spring which bears between the step 22 and the shoulder 32. In alternate embodiments this spring may be implemented in other forms, placed in other positions, or integrated with other components. For example, the spring 50 may be embodied as a leaf spring, or it may be integrated into the ring. Furthermore, if a coil spring is used, it may be employed as either a compression or an extension spring with suitable alterations to the design of FIG. 1.

An engaging spring 46 such as the Illustrated coil spring biases the ring and the collar 34 to the left as shown in FIG. 1. Resilient forces supplied by the engaging spring 48 tend to push the pin 24 to the engaging position shown In FIG. 1. The engaging spring 48 has a first end 60 that bears directly on the ring 44 and a second end 62. The second end 62 bears directly on a stop ring 63, and the stop ring 63 in turn bears directly on a shoulder 64. The shoulder 64 is a transition between a radially outer surface 66 and a radially inner surface 68. In this example, the spring 48 extends farther than the radially outer surface 66 radially away from the longitudinal axis L. The spring 48 comprises a wire having a wire center 70, and in this example the wire center 70 extends farther than the radially outer surface 66 radially away from the longitudinal axis L. The spring 48 defines an inner spring diameter and an outer spring diameter adjacent the shoulder 64, and the radially outer surface 66 defines a surface diameter adjacent the spring 48. In this example, the surface diameter is greater than the inner spring diameter and less than the outer spring diameter.

The shoulder 64 can be formed in many ways, as for example by machining the radially inner surface 68 or by upsetting the extension bar E. In this example, the engaging spring 48 provides a greater spring force than the releasing spring 50 such that the engaging spring 48 compresses the releasing spring 50 and holds the pin 24 in the engaging position in the absence of external forces on the collar 34. As shown in FIG. 1, the stop ring 63 is received within the collar 34, and the stop ring 63 centers and guides the sliding movement of the collar 34 relative to the drive stud 10 as the collar 34 moves along the direction of the longitudinal axis L. Alternatively, the stop ring 63 may be sized to remain out of contact with the collar 34, such that the stop ring 63 performs no collar-guiding function.

The collar 34 is held in place on the drive stud 10 by a retaining ring 56 that can be a spring ring received in a recess 54 formed in the drive stud 10. The retaining ring 56 is sized to fit within the first recess 36 when the collar 34 is in the position shown in FIG. 1. Though a retaining ring is preferred, other approaches can be used to hold the collar in the assembled position shown in the drawings. For example, an upset may be formed on the drive stud or the collar to hold the collar in place while allowing axial sliding movement. Other means such as a pin may be used, in which case the recess 36 is not needed.

The operation of the quick release mechanism described above is similar to the operation of the quick release mechanism shown in U.S. Pat. No. 5,644,958, assigned to the assignee of the present invention and hereby incorporated by reference in its entirety. As shown in FIG. 1 of the '958 patent, when the first portion 12 of the drive stud 10 is brought into alignment with a socket, the first end 26 of the locking pin 24 bears on the socket.

As shown in FIG. 3 of the '958 patent, further movement of the drive stud 10 into the socket moves the pin 24 inwardly in the opening 16, thereby allowing the first portion 12 to move within the socket. This can be done without manipulating the collar 34 in any way.

As shown in FIG. 4 of the '958 patent, when the drive stud 10 is fully seated in the socket the spring 48 biases the locking pin 24 toward the engaging position, in which the first end 26 of the locking pin 24 engages the recess in the socket. The pin 24 will provide at least frictional engagement, even with a socket which does not include a recess.

As shown in FIG. 5 of the '958 patent, forces tending to remove the socket from the drive stud 10 are not effective to move the locking pin 24 out of the recess, and the socket is positively held in place on the drive stud 10.

As shown in FIG. 6 of the '958 patent, the collar 34 can be used to release the socket. As the collar 34 is moved away from the socket, the ring 44 is moved away from the socket, and the engaging spring 48 is compressed. The releasing spring 50 then moves the pin 24 to the release position of FIG. 6 of the '958 patent. When the locking pin 24 reaches the release position the socket is free to fall from the drive stud 10 under the force of gravity.

The pin 24 is not subjected to any significant side loading, because the collar 34 and the ring 44 are both free to rotate freely on the drive stud 10. Because the ring 44 is slidable with respect to the collar 44, the pin 44 can move the ring 44 away from the socket to compress the engaging spring 48, without moving the collar 34.

In other embodiments, the sliding surface 46 may have other shapes, such as a discontinuous surface or a plurality of surfaces, to allow relative movement between sliding surface 46 and pin 24 without binding. Thus, it is contemplated to employ all combinations of shapes for the sliding surface 46 and the pin 24 which allow them to cooperate with each other so as to move relative to each other without binding.

In alternate embodiments the sliding surface 46 can be oriented at other angles as desired. The orientation of the sliding surface 46 with respect to the longitudinal axis L can be selected to provide the desired relationship between the stroke of the collar 34 and the stroke of the pin 24.

The shoulder 64 is one example of an integral raised stop against which the engaging spring reacts. Other integral raised stops may extend completely around the drive stud, or alternatively they may be localized in one or more limited regions of the circumference of the drive stud. Integral raised stops may be formed by removing material from the drive stud (e.g., by machining operations), by shaping the drive stud (e.g., by upsetting operations), or by securing an element to the drive stud (e.g., by welding or soldering a metallic element to the drive stud or by adhesively securing an epoxy, metallic or other element to the drive stud).

This invention can be adapted for use with the widest range of torque transmitting tools, including hand tools, power tools and impact tools. Simply by way of illustration, this invention can be used with socket wrenches, including those having ratchets, T-bar wrenches, speeder wrenches and others, as described and shown in U.S. Pat. No. 4,848,196. Furthermore, this invention is not limited to sockets of the type shown, but can be used with a wide range of tool attachments, including sockets or tool attachments with recesses of various sizes, and even on sockets without a recess of any type.

Of course, the quick release mechanism of this invention can be used in any physical orientation, and terms such as "left" have been used for convenience of reference. Furthermore, the terms "engaging position" and "release position" are each intended to encompass multiple positions within a selected range. For example, the exact position of the engaging position will vary with the depth of the recess in the socket, and the exact position of the release position may vary with a variety of factors, including the extent to which the actuating member is moved, and the shape (square or other) of the female opening in the socket or other tool attachment.

As suggested above, the present invention can be implemented in many ways, and this invention is not limited to the specific embodiments shown in the drawings. However, in order to define the presently preferred embodiment of this invention the following details of construction are provided. Of course, these details are in no way intended to limit the scope of this invention.

By way of example, the pin 24 may be formed of a material such as a steel of moderate to mild temper, and the collar 34, the ring 44, and the retainer 56 may be formed of any suitable material such as brass, steel, other alloy or plastic.

The mechanism shown in the drawings is low profile with respect to the circumference of the extension bar E. The disclosed mechanism is simple to manufacture and assemble, and it requires relatively few parts. It is rugged in operation, and it automatically engages a socket as described above. Because of its design for selective alignment, the mechanism will accommodate various types of sockets and will self-adjust for wear. In the illustrated embodiment, the collar 34 may be gripped at any point on its circumference, and does not require the operator to use a preferred angular orientation of the tool.

The illustrated design provides a number of other advantages. Because the diameter of the extension bar E in the region of the spring 48 is only slightly smaller than the diameter of the extension bar on the other side of the shoulder 64, the strength of the extension bar E is not reduced by a severe reduction in diameter. Furthermore, because both the ring 44 and the stop ring 63 are symmetrical about their respective mid-planes 72, 74, each can be assembled in either orientation. This facilitates reliable assembly and reduces manufacturing costs.

In some alternate embodiments, the locking element may be configured to require a positive action on the part of the operator to retract the locking element as the drive stud is moved Into the socket. Certain of these embodiments may require recesses in the sockets as described above to provide all of the functional advantages described. As another alternative, In some cases the stop ring 63 may be deleted, and the end 62 of the spring 46 may bear directly on the shoulder 64, as shown in FIG. 2.

As used herein, the term "coupled with" is intended broadly to encompass elements that are coupled together directly or Indirectly. Thus, a first element is said to be coupled with a second element whether or not there are intervening (unnamed) elements between the first and second elements. Similarly, a first element Is said to be positioned between second and third elements whether or not the first element is in direct contact with the second and third elements, and whether or not them are intervening (unnamed) elements.

It is intended that the foregoing detailed description be regarded as illustrative rather than limiting, and that it be understood that it is the following claims, including all equivalents, which are intended to define the scope of this invention.

The invention claimed is:

1. A quick release mechanism comprising:

a tool comprising a drive stud comprising an out-of-round drive portion, an adjacent portion, and a passageway extending obliquely with respect to a longitudinal axis defined by the drive stud between a first end at the drive portion and a second end at the adjacent portion, said out-of-round portion shaped to fit within a tool attachment to apply torque to the tool attachment;

a locking element slidably received In the passageway to slide between a tool attachment engaging position and a tool attachment release position;

a coil spring extending around the adjacent portion, said spring comprising a first end coupled with the locking element to bias the locking element to the tool engaging position, and a second end;

a shoulder formed by the adjacent portion and facing the spring, said shoulder forming a transition between a radially outer surface and a radially inner surface, wherein the shoulder is interposed between the radially outer surface and the spring;

a ring disposed around the adjacent portion between the second end of the spring and the shoulder;

a collar extending around the spring and the ring; and a second ring extending around the adjacent portion between the locking element and the first end of the spring, said second ring transferring biasing forces from the spring to the locking element;

said spring extending father than said radially outer surface radially away from the longitudinal axis.

2. The invention of claim 1 wherein the ring centers the collar on the tool as the collar moves along the longitudinal direction relative to the drive stud and the ring.

3. The invention of claim 1 wherein the collar comprises a ledge that engages the ring on a side of the ring opposite the spring.

4. The invention of claim 1 wherein the spring comprises a coiled wire characterized by a wire center, and wherein the wire center of a portion of the spring facing the shoulder extends farther than said radially outer surface radially away from the longitudinal axis.

5. The invention of claim 1 wherein the second end of the spring bears directly on the ring, and wherein the ring bears directly on the shoulder.

6. The invention of claim 1 wherein the ring is symmetrical about a mid-plane oriented transverse to the longitudinal axis.

7. The invention of claim 1 wherein a portion of the spring facing the shoulder defines an inner spring diameter and an outer spring diameter, wherein the radially outer surface defines a surface diameter adjacent the spring, and wherein the surface diameter is greater than the inner spring diameter and less than the outer spring diameter.

8. A quick release mechanism comprising:

a tool comprising a drive stud comprising an out-of-round drive portion, an adjacent portion, and a passageway extending obliquely with respect to a longitudinal axis defined by the drive stud between a first end at the drive portion and a second end at the adjacent portion, said out-of-round portion shaped to fit within a tool attachment to apply torque to the tool attachment;

a looking element slidably received in the passageway to slide between a tool attachment engaging position and a tool attachment release position;

a coil spring extending around the adjacent portion, said spring comprising a first end coupled with the locking element to bias the locking element to the tool engaging position, and a second end;

an integral raised stop extending radially outwardly from the adjacent portion of the drive stud;

a ring extending around the adjacent portion between the locking element and the first end of the spring, said ring transferring biasing forces from the spring to the locking element; and a collar extending around the spring and the ring;

said spring reading against said raised stop and extending farther than said raised stop radially away from the longitudinal axis.

9. The invention of claim 1 or 8 further comprising a releasing spring biasing the looking element toward the tool attachment releasing position.

10. The invention of claim 8 wherein a portion of the spring facing the raised stop defines an inner spring diameter and an outer spring diameter, wherein the raised stop defines a stop diameter adjacent the spring, and wherein the stop diameter is greater than the inner spring diameter and less than the outer spring diameter.

11. The invention of claim 8 wherein the raised stop comprises a shoulder.

12. The invention of claim 8 wherein the raised stop comprises an upset portion of the drive stud.

13. The invention of claim 8 wherein the raised stop comprises an element secured to the drive stud.

14. The invention of claim 13 wherein the element comprises a material selected from the group consisting of metals and epoxies.

15. A quick release mechanism comprising:

a tool comprising a drive stud comprising an out-of-round drive portion, an adjacent portion, and a passageway extending obliquely with respect to a longitudinal axis defined by the drive stud between a first end at the drive portion and a second end at the adjacent portion, said out-of-round portion shaped to fit within a tool attachment to apply torque to the tool attachment;

a locking element slidably received in the passageway to slide between a tool attachment engaging position and a tool attachment release position; and a coil spring extending around the adjacent portion, said spring comprising a first end coupled with the locking element to bias the looking element to the tool engaging position, and a second end;

wherein the locking element comprises a first end shaped to engage the tool attachment, an intermediate portion, and a second end, wherein the second end comprises a smaller diameter than a diameter of the intermediate portion.

16. The invention of claim 15 further comprising:

an integral raised stop extending radially outwardly from the adjacent portion of the drive stud;

a collar extending around the spring and a ring; and a second ring extending around the adjacent portion between the locking element and the first end of the spring, said second ring transferring biasing forces from the spring to the locking element.

17. A quick release mechanism comprising:

a tool comprising a drive stud comprising an out-of-round drive portion, an adjacent portion, an upset portion extending radially outwardly from the adjacent portion, and a passageway extending obliquely with respect to a longitudinal axis defined by the drive stud between a first end at the drive portion and a second end at the adjacent portion, the out-of-round portion shaped to fit within a tool attachment to apply torque to the tool attachment;

a locking element slidably received in the passageway to slide between a tool attachment engaging position and a tool attachment release position; and a coil spring extending around the adjacent portion, the spring comprising a first end coupled with the looking element to bias the locking element to the tool engaging position, and a second end reading against the upset portion;

wherein the upset portion extends radially outwardly from the adjacent portion of the drive stud, and wherein the spring extends farther than the upset portion radially away from the longitudinal axis.

18. A quick release mechanism comprising:

a tool comprising a drive stud comprising an out-of-round drive portion, an adjacent portion, an upset portion extending radially outwardly from the adjacent portion, and a passageway extending obliquely with respect to a longitudinal axis defined by the drive stud between a first end at the drive portion and a second end at the adjacent portion, the out-of-round portion shaped to fit within a tool attachment to apply torque to the tool attachment;

a locking element slidably received in the passageway to slide between a tool attachment engaging position and a tool attachment release position; and a coil spring extending around the adjacent portion, the spring comprising a first end coupled with the locking element to bias the locking element to the tool engaging position, and a second end reacting against the upset portion;

wherein a portion of the spring facing the upset portion defines an inner spring diameter and en outer spring diameter, wherein the upset portion defines a stop diameter adjacent the spring, and wherein the stop diameter is greater than the inner spring diameter and less than the outer spring diameter.

19. A quick release mechanism comprising:

a tool comprising a drive stud comprising an out-of-round drive portion, an adjacent portion, an upset portion extending radially outwardly from the adjacent portion, and a passageway extending obliquely with respect to a longitudinal axis defined by the drive stud between a first end at the drive portion and a second end at the adjacent portion, the out-of-round portion shaped to fit within a tool attachment to apply torque to the tool attachment;

a locking element slidably received in the passageway to slide between a tool attachment engaging position and a tool attachment release position;

a coil spring extending around the adjacent portion, the spring comprising a first end coupled with the locking element to bias the locking element to the tool engaging position, and a second end reacting against the upset portion; and a ring disposed around the adjacent portion between the second end of the spring and the upset portion.

20. The invention of claim 19 wherein the ring is symmetrical about a mid-plane oriented transverse to the longitudinal axis.

21. The invention of claim 19 wherein the second end of the spring bears directly on the ring, and wherein the ring bears directly on the upset portion.

22. The invention of claim 19 further comprising a collar extending around the spring and the ring.

23. The invention of claim 22 wherein the ring centers the collar on the tool as the collar moves along the longitudinal direction relative to the drive stud and the ring.

24. The invention of claim 22 further comprising a second ring extending around the adjacent portion between the locking element and the first end of the spring, the second ring transferring biasing forces from the spring to the locking element.

25. The invention of claim 24 wherein the collar comprises a ledge that engages the second ring on a side of the second ring opposite the spring.

26. The invention of claim 19 further comprising a second ring extending around the adjacent portion between the locking element and the first end of the spring, the second ring transferring biasing forces from the spring to the locking element.

27. A quick release mechanism comprising:

a tool comprising a drive stud comprising an out-of-round drive portion, an adjacent portion, and a passageway extending obliquely with respect to a longitudinal axis defined by the drive stud between a first end at the drive portion and a second end at the adjacent portion, said out-of-round portion shaped to fit within a tool attachment to apply torque to the tool attachment;

a locking element slidably received in the passageway to slide between a tool attachment engaging position and a tool attachment release position;

a coil spring extending around the adjacent portion, said spring comprising a first end coupled with the locking element to bias the locking element to the tool engaging position, and a second end;

a shoulder formed by the adjacent portion and facing the spring, said shoulder forming a transition between a radially outer surface and a radially inner surface, wherein the shoulder is interposed between the radially outer surface and the spring, wherein the spring axially overlaps the radially inner surface; and a ring disposed around the adjacent portion between the second end of the spring and the shoulder;

said spring extending farther than said radially outer surface radially away from the longitudinal axis.

28. The invention of claim 27 further comprising a collar extending around the spring and the ring.

29. The invention of claim 28 wherein the ring centers the collar on the tool as the collar moves along the longitudinal direction relative to the drive stud and the ring.

30. The invention of claim 28 further comprising a second ring extending around the adjacent portion between the locking element and the first end of the spring, said second ring transferring biasing forces from the spring to the locking element.

31. The invention of claim 30 wherein the collar comprises a ledge that engages the second ring on a side of the second ring opposite the spring.

32. The invention of claim 27 wherein the second end of the spring bears directly on the ring, and wherein the ring bears directly on the shoulder.

33. The invention of claim 27 wherein the ring is symmetrical about a mid-plane oriented transverse to the longitudinal axis.

34. The invention of claim 27 wherein a portion of the spring facing the shoulder defines an inner spring diameter and an outer spring diameter, wherein the radially outer surface defines a surface diameter adjacent the spring, and wherein the surface diameter is greater than the inner spring diameter and less than the outer spring diameter.

35. A quick release mechanism comprising:

a tool comprising a drive stud comprising en out-of-round drive portion, an adjacent portion, and a passageway extending obliquely with respect to a longitudinal axis defined by the drive stud between a first end at the drive portion and a second end at the adjacent portion, said out-of-round portion shaped to fit within a tool attachment to apply torque to the tool attachment;

a locking element slidably received in the passageway to slide between a tool attachment engaging position and a tool attachment release position;

a coil spring extending around the adjacent portion, said spring comprising a first end coupled with the locking element to bias the locking element to the tool engaging position, and a second end; and a shoulder formed by the adjacent portion and facing the spring, said shoulder forming a transition between a radially outer surface and a radially inner surface, wherein the shoulder is interposed between the radially outer surface and the spring, wherein the spring axially overlaps the radially inner surface;

said spring reacting against said shoulder and extending farther than said radially outer surface radially away from the longitudinal axis;

wherein a portion of the spring facing the shoulder defines an inner spring diameter and an outer spring diameter, wherein the radially outer surface defines a surface diameter adjacent the spring, and wherein the surface diameter is greater than the inner spring diameter and less than the outer spring diameter.

36. The invention of claim 27 or 35 wherein the spring comprises a coiled wire characterized by a wire center, and wherein the wire center of a portion of the spring facing the shoulder extends farther than said radially outer surface radially away from the longitudinal axis.

37. A quick release mechanism comprising:

a tool comprising a drive stud comprising an out-of-round drive portion, an adjacent portion, and a passageway extending obliquely with respect to a longitudinal axis defined by the drive stud between a first end at the drive portion and a second end at the adjacent portion, said out-of-round portion shaped to fit within a tool attachment to apply torque to the tool attachment;

a locking element slidably received in the passageway to slide between a tool attachment engaging position and a tool attachment release position;

a coil spring extending around the adjacent portion, said spring comprising a first end coupled with the locking element to bias the locking element to the tool engaging position, and a second end; and an integral raised stop extending radially outwardly from the adjacent portion of the drive stud, said raised stop adjacent a radially inner surface, wherein the spring axially overlaps the radially inner surface;

said spring reacting against said raised stop and extending farther than said raised stop radially away from the longitudinal axis;

wherein a portion of the spring facing the raised stop defines an inner spring diameter and an outer spring diameter, wherein the raised stop defines a stop diameter adjacent the spring and wherein the stop diameter is greater than the inner spring diameter and less than the outer spring diameter.

38. The invention of claim 27, 35 or 37 further comprising a releasing spring biasing the locking element toward the tool attachment releasing position.

39. The invention of claim 37 wherein the raised stop comprises a shoulder.

40. The invention of claim 37 wherein the raised stop comprises an upset portion of the drive stud.

41. The invention of claim 37 wherein the raised stop comprises an element secured to the drive stud.

42. The invention of claim 41 wherein the element comprises a material selected from the group consisting of metals and epoxies.

* * * * *

UNITED STATES PATENT AND TRADEMARK OFFICE

CERTIFICATE OF CORRECTION

PATENT NO. : 7,398,713 B2
APPLICATION NO. : 10/520776
DATED : July 15, 2008
INVENTOR(S) : John B. Davidson It is certified that error appears in the above-identified patent and that said Letters Patent is hereby corrected as shown below:

In column 5, claim 1, line 64, after “slidably received” delete “In” and substitute --in-- in its place.

In column 6, claim 1, line 17, after “spring extending” delete “father” and substitute --farther-- in its place.

In column 6, claim 8, line 50, before “element slidably” delete “looking” and substitute --locking-- in its place.

In column 6, claim 8, line 64, after “said spring” delete “reading” and substitute --reacting-- in its place.

In column 7, claim 9, line 2, after “spring biasing the” delete “looking” and substitute --locking-- in its place.

In column 7, claim 17, line 60, after “coupled with the” delete “looking” and substitute --locking-- in its place.

In column 7, claim 17, line 62, after “and a second end” delete “reading” and substitute --reacting-- in its place.

In column 8, claim 18, line 19, after “spring diameter and” delete “en” and substitute --an-- in its place.

UNITED STATES PATENT AND TRADEMARK OFFICE

CERTIFICATE OF CORRECTION

PATENT NO. : 7,398,713 B2
APPLICATION NO. : 10/520776
DATED : July 15, 2008
INVENTOR(S) : John B. Davidson It is certified that error appears in the above-identified patent and that said Letters Patent is hereby corrected as shown below:

In column 9, claim 35, line 52, after "drive stud comprising" delete "en" and substitute --an-- in its place.

Signed and Sealed this

Nineteenth Day of May, 2009

JOHN DOLL
*Acting Director of the United States Patent and Trademark Office*